US011700469B2

(12) United States Patent
Watanabe et al.

(10) Patent No.: US 11,700,469 B2
(45) Date of Patent: Jul. 11, 2023

(54) MICROPHONE

(71) Applicant: HOSIDEN CORPORATION, Osaka (JP)

(72) Inventors: Kazuki Watanabe, Fukuoka (JP); Kentaro Ishihara, Fukuoka (JP); Ryuji Awamura, Fukuoka (JP); Kensuke Nakanishi, Fukuoka (JP)

(73) Assignee: HOSIDEN CORPORATION, Osaka (JP)

( * ) Notice: Subject to any disclaimer, the term of this patent is extended or adjusted under 35 U.S.C. 154(b) by 0 days.

(21) Appl. No.: 17/586,263

(22) Filed: Jan. 27, 2022

(65) Prior Publication Data

US 2022/0256265 A1 Aug. 11, 2022

(30) Foreign Application Priority Data

Feb. 10, 2021 (JP) ..... 2021-019672

(51) Int. Cl.
*H04R 1/02* (2006.01)
*H04R 1/08* (2006.01)

(52) U.S. Cl.
CPC ..... *H04R 1/02* (2013.01); *H04R 1/08* (2013.01)

(58) Field of Classification Search
None
See application file for complete search history.

(56) References Cited

U.S. PATENT DOCUMENTS

| | | | | |
|---|---|---|---|---|
| 2007/0165898 | A1 | 7/2007 | Huang et al. | |
| 2013/0004009 | A1 | 1/2013 | Matsui et al. | |
| 2016/0192045 | A1 | 6/2016 | Akino | |
| 2021/0306761 | A1* | 9/2021 | Foletta | H04R 1/342 |

FOREIGN PATENT DOCUMENTS

| | | |
|---|---|---|
| JP | H02-66095 | 5/1990 |
| JP | 2004-297765 | 10/2004 |
| JP | 2018-125641 A | 8/2018 |

OTHER PUBLICATIONS

Extended European Search Report Issued in Corresponding EP Patent Application No. 22152530.6, dated Jul. 6, 2022.

* cited by examiner

*Primary Examiner* — Kenny H Truong
(74) *Attorney, Agent, or Firm* — Greenblum & Bernstein, P.L.C.

(57) ABSTRACT

A microphone includes a tubular case having a bottom surface, a side surface and an opened top, a substrate which is fixed so as to block an opening portion of the opened top of the case, and has an electrode portion on an upper surface thereof, and a side-surface sound hole formed in the side surface of the case.

3 Claims, 6 Drawing Sheets

*Prior Art*

MICROPHONE

TECHNICAL FIELD

The present invention relates to a microphone.

BACKGROUND ART

Japanese Patent Application Laid Open No. 2018-125641 (hereinafter referred to as Patent Literature 1) and the like disclose examples of conventional microphone units.

For the purpose of increasing the level of a signal to be output from a microphone when a sound source is located in a predetermined direction, the microphone unit disclosed in Patent Literature 1 includes a bottom surface portion, wall portions surrounding the peripheral edge of the bottom surface portion, an accommodation portion for accommodating a microphone, a main body portion having an opened surface, a lid portion that covers a part of the opened surface and is in contact with the accommodation portion, a first opening portion opened between the lid portion and one end portion in a longitudinal direction of the main body portion on the opened surface, and a second opening portion opened between the lid portion and the other end portion in the longitudinal direction of the main body portion on the opened surface.

A microphone case as shown in FIG. 1 is used when the microphone unit disclosed in Patent Literature 1 is incorporated into a set as an in-vehicle microphone, which causes a problem that it is impossible to reduce the size of the microphone because it is necessary to provide a gap A between the microphone case and the microphone unit in order to form an acoustic characteristic. Further, sound holes have been conventionally provided in a substrate, and therefore the sound holes and an electrical connection portion are present on the same plane, which has caused a requirement of preventing occurrence of air leakage at the electrical connection portion in consideration of acoustic aspects. Therefore, there have been many structural restrictions.

SUMMARY OF THE INVENTION

Therefore, an object of the present invention is to provide a compact and highly-sensitive microphone.

A microphone according to the present invention comprises: a tubular case having a bottom surface, a side surface, and an opened top; a substrate which is fixed so as to block an opening portion of the opened top of the case, and has an electrode portion on an upper surface thereof; and a side-surface sound hole formed in the side surface of the case.

Effects of the Invention

According to the present invention, it is possible to realize a compact and highly-sensitive microphone.

DETAILED DESCRIPTION

Figure 1:
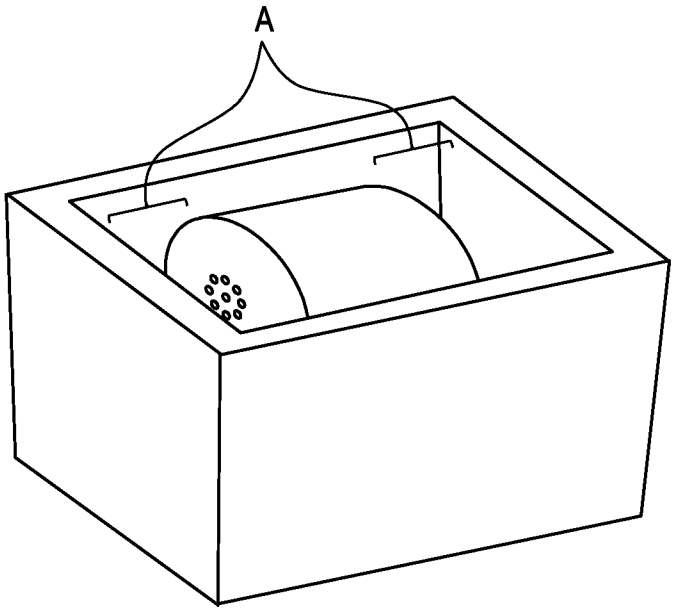
FIG. 1 is a schematic view of a microphone unit and a microphone case of a prior art.

Hereinafter, an embodiment of the present invention will be described in detail. Components having the same functions are designated by the same reference numerals, and description thereof will not be repeated.

First Embodiment

Figure 2:
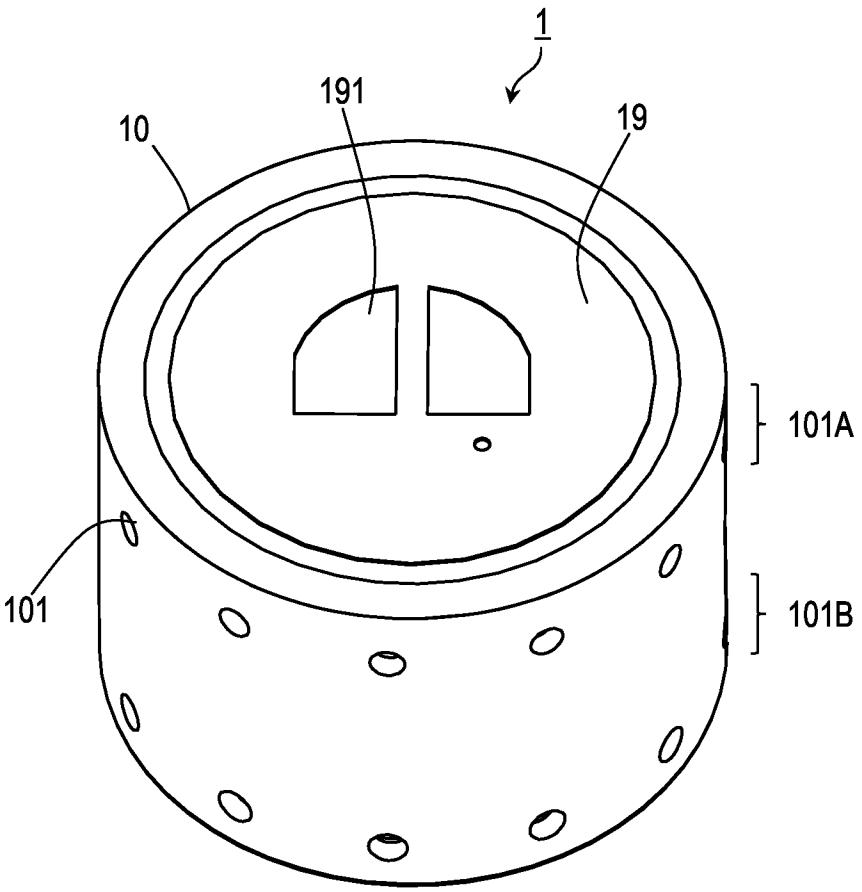
FIG. 2 is a perspective view of a microphone of a first embodiment.

Hereinafter, the structure of a microphone 1 of a first embodiment will be described with reference to FIGS. 2 to 6. As shown in FIG. 2, the microphone 1 of the present embodiment is configured to comprise a tubular case 10 having a bottom surface, a side surface, and an opened top, a substrate 19 which is fixed so as to block an opening portion of the opened top of the case 10, and has an electrode portion 191 on the upper surface thereof, and side-surface sound holes 101 formed in the side surface of the case 10. Note that the microphone 1 of the present embodiment is assumed to be an ECM (electric condenser microphone).

The shape of the case 10 is not limited to a tubular (cylindrical) shape, but may be an angular tubular shape (for example, a triangular tubular shape, a square tubular shape, a hexagonal tubular shape and the like). When the case 10 is configured to have a square tubular shape, a holder 9 described later may be omitted.

A plurality of side-surface sound holes 101 are suitably formed over the entire circumference of the side surface of the case 10. By forming a plurality of side-surface sound holes 101 over the entire circumference of the side surface of the case 10, it is possible to insert the microphone 1 into the holder 9 described later in any orientation, so that the assembling cost can be reduced.

By forming a sound hole group (upper sound hole group 101A) making a round of an upper end portion of the side surface and also forming a sound hole group (lower sound hole group 101B) making a round of a lower end portion of the side surface as shown in FIG. 2, it is possible to use the upper sound hole group 101A and the lower sound hole group 101B as front-surface sound holes and back-surface sound holes respectively, so that it is not necessary to provide a space (an internal space for forming an acoustic characteristic) corresponding to the gap A shown in FIG. 1 and thus it is possible to reduce the size of the microphone. Further, since it is not necessary to provide sound holes in the substrate 19, it is unnecessary to take a measure against flux scattering during soldering, so that man-hours and costs related to jigs can be reduced.

Figure 3:
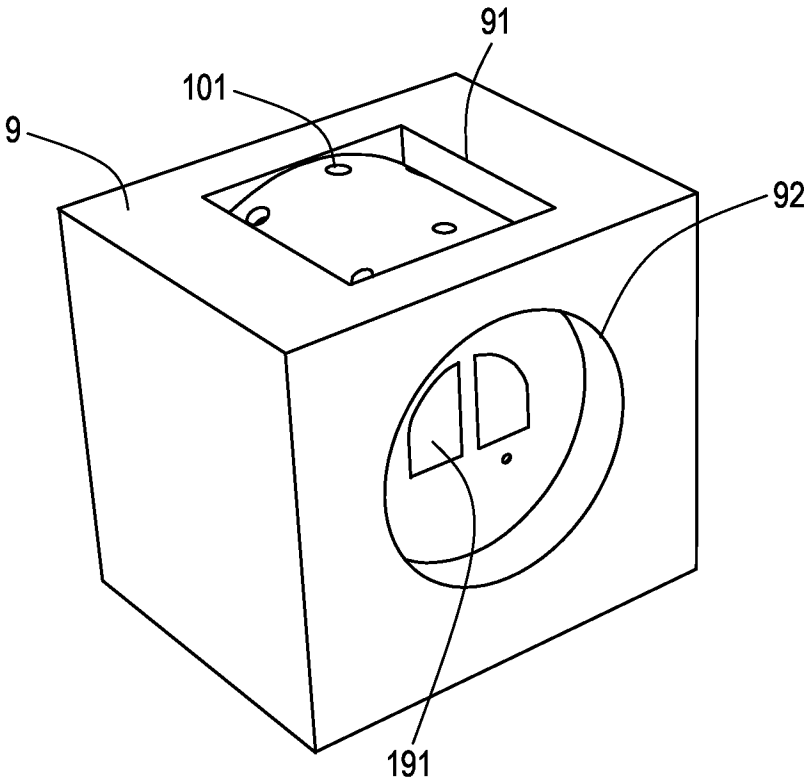
FIG. 3 is a perspective view of the microphone of the first embodiment (outfitted with a holder)

As shown in FIG. 3, the microphone 1 can be outfitted with the holder 9. The material of the holder 9 may be, for example, resin or rubber. The holder 9 includes a first hole 91 for exposing the side-surface sound holes 101 to the outside and a second hole 92 for exposing an electrode portion 191 to the outside, and is formed so as to cover the case 10. By exposing only some of the plurality of side-surface sound holes 101 from the holder 9, it is possible to let the microphone 1 have directivity along a necessary surface.

Figure 4:
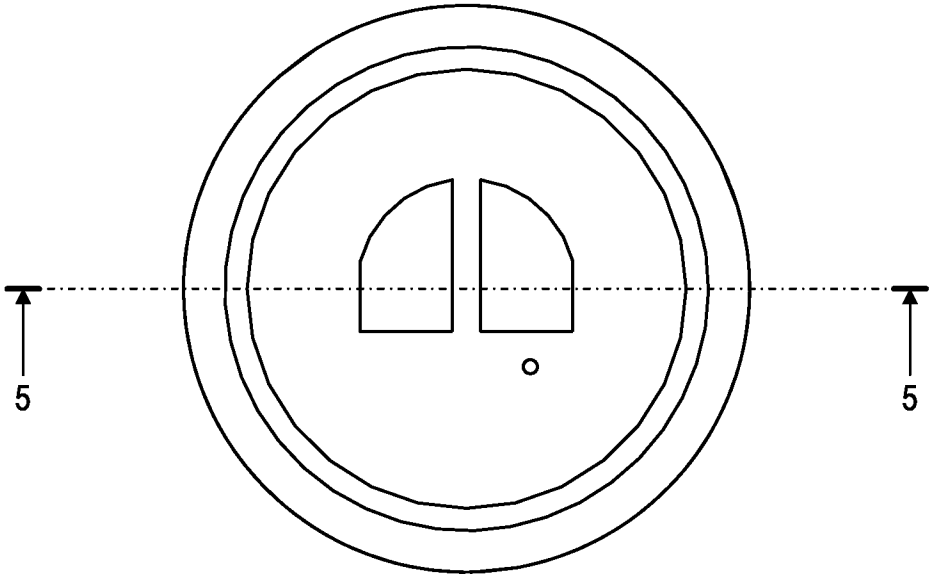
FIG. 4 is a plan view of the microphone of the first embodiment.
Figure 5:
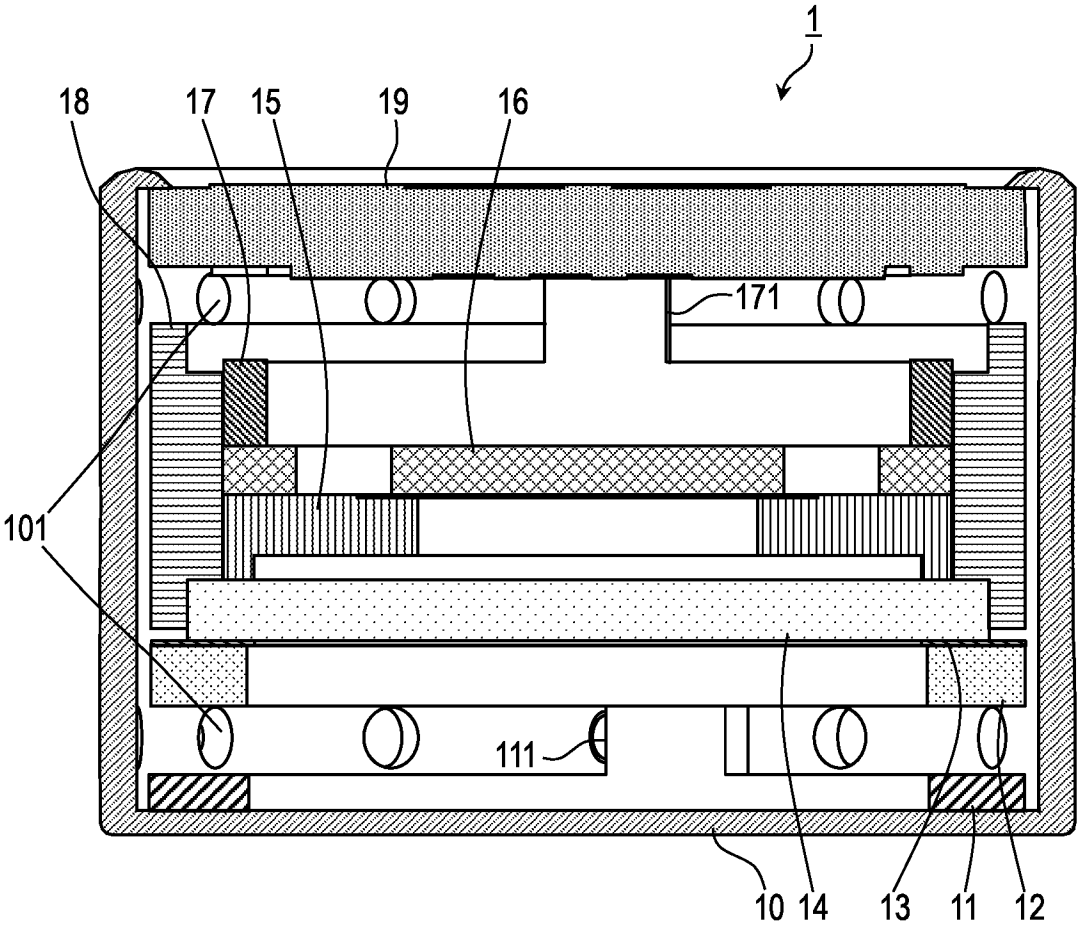
FIG. 5 is a cross-sectional view based on a projection direction indicated by a cutting line 5-5 and arrows in FIG. 4.

Further, as shown in FIGS. 4 and 5, the microphone 1 of the present embodiment comprises a ring-shaped first ring 11 which is to be mounted on the bottom of the case 10, and has a plurality of leg portions 111 extending in an axial direction of the case 10, a disk-shaped diaphragm 12 having a thin central portion to be mounted on the first ring 11, a thin ring-shaped spacer 13 to be mounted on the upper surface of the diaphragm 12, a disk-shaped back plate 14 to be mounted on the spacer 13, a second ring 15 to be mounted on the back plate 14, a disc-shaped gate plate 16 to be mounted on the second ring 15, a ring-shaped gate ring 17 which is to be mounted on the gate plate 16 and has a plurality of leg portions 171 extending in the axial direction of the case 10, a tubular-shaped holder 18 which is to be mounted on the proximity of the outer periphery of the upper surface of the back plate 14 and surrounds the second ring 15, the gate plate 16 and the gate ring 17, and a substrate 19 to be mounted on the gate ring 17.

As shown in FIG. 5, the side-surface sound holes 101 are suitably formed in the side surface of the case 10 and at positions where the side-surface sound holes 101 communicate with gaps caused in the case by the leg portions 111 and 171. By forming the side-surface sound hole 101 at the position where the side-surface sound hole 111 communicates with the gap in the case, a sound path can be secured, and the sensitivity of the microphone can be enhanced.

Figure 6:
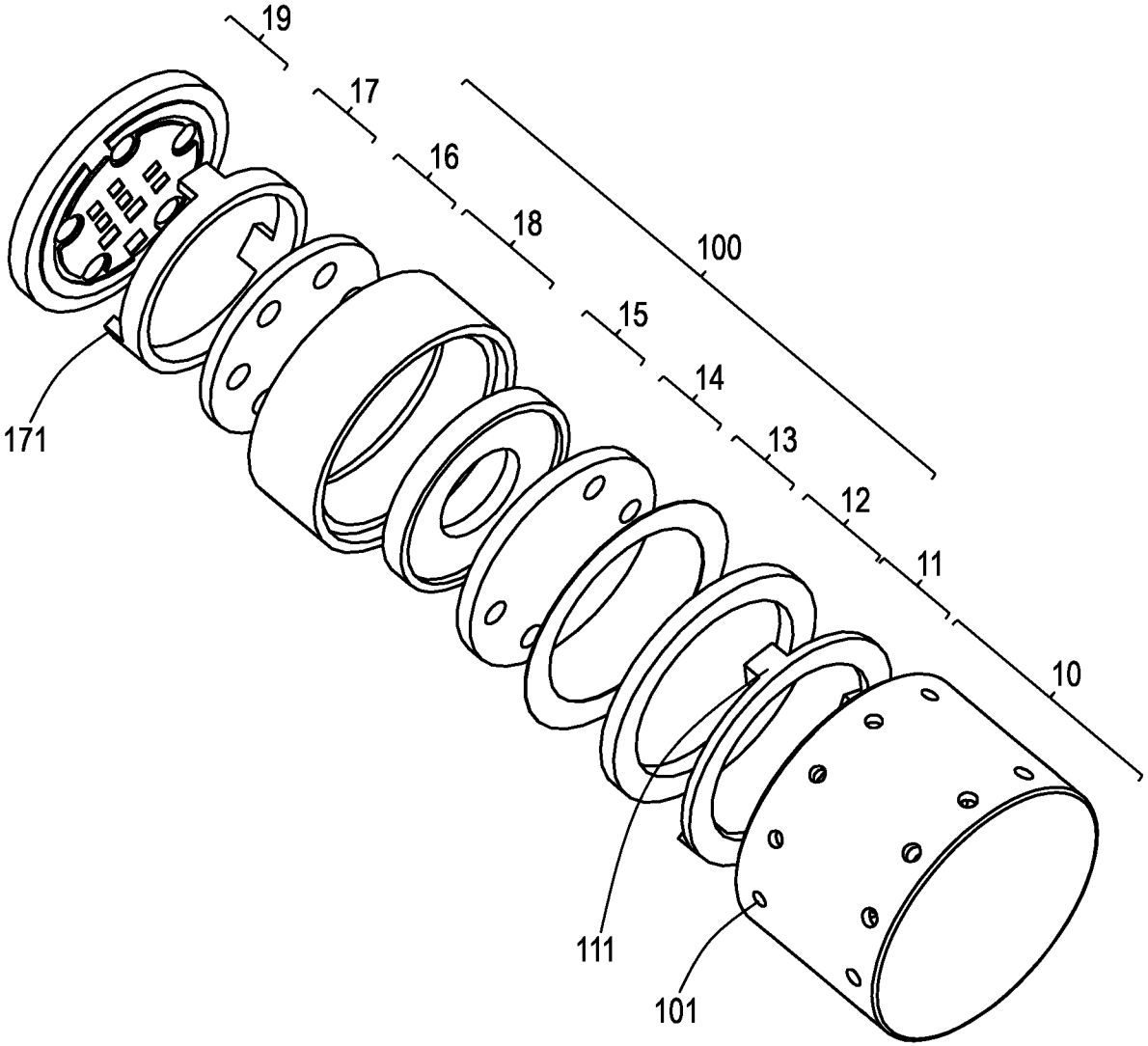
FIG. 6 is an exploded perspective view of the microphone of the first embodiment.

As shown in FIG. 6, an assembly obtained by assembling the diaphragm 12, the spacer 13, the back plate 14, the second ring 15, the gate plate 16, and the holder 18 is referred to as a microphone assembly 100. In this case, the microphone assembly 100 is mounted on the first ring 11, and the gate ring 17 is mounted on an upper portion of the microphone assembly 100.

In the first embodiment, it has been described that the microphone 1 is brought with directivity along a necessary surface. However, the present invention is not limited to this style, and the microphone 1 may be configured as an omnidirectional microphone. In this case, one of either the upper sound hole group 101A or the lower sound hole group 101B may be formed in the side surface of the case 10.

What is claimed is:

1. A microphone comprising:

a tubular case having a bottom surface, a side surface, and an opened top;

a substrate which is fixed so as to block an opening portion of the opened top of the tubular case, and has an electrode portion on an upper surface thereof;

a side-surface sound hole formed in the side surface of the tubular case;

a ring which is to be mounted on a bottom of the tubular case and has a plurality of leg portions extending in an axial direction of the tubular case;

a microphone assembly to be mounted on the ring; and a gate ring which is to be mounted on an upper portion of the microphone assembly, and has a plurality of leg portions extending in an axial direction of the tubular case, wherein the substrate is mounted on the gate ring, and the side-surface sound hole is formed in the side surface of the tubular case and at a position where the side-surface sound hole communicates with a gap caused in the tubular case by the leg portions of the ring and the leg portions of the gate ring.

2. A microphone comprising:

a tubular case having a bottom surface, a side surface, and an opened top;

a substrate which is fixed so as to block an opening portion of the opened top of the tubular case, and has an electrode portion on an upper surface thereof;

a side-surface sound hole formed in the side surface of the tubular case, and the side-surface sound hole includes a plurality of side-surface sound holes formed over an entire circumference of the side surface of the tubular case;

a ring which is to be mounted on a bottom of the tubular case and has a plurality of leg portions extending in an axial direction of the tubular case;

a microphone assembly to be mounted on the ring; and a gate ring which is to be mounted on an upper portion of the microphone assembly, and has a plurality of leg portions extending in an axial direction of the tubular case, wherein the substrate is mounted on the gate ring, and the side-surface sound hole is formed in the side surface of the tubular case and at a position where the side-surface sound hole communicates with a gap caused in the tubular case by the leg portions of the ring and the leg portions of the gate ring.

3. A microphone comprising:

a tubular case having a bottom surface, a side surface, and an opened top;

a substrate which is fixed so as to block an opening portion of the opened top of the tubular case, and has an electrode portion on an upper surface thereof;

a side-surface sound hole formed in the side surface of the tubular case, and the side-surface sound hole includes a plurality of side-surface sound holes formed over an entire circumference of the side surface of the tubular case;

a holder which includes a first hole for exposing the side-surface sound holes to the outside, and a second hole for exposing the electrode portion to the outside, and covers the tubular case;

a ring which is to be mounted on a bottom of the tubular case and has a plurality of leg portions extending in an axial direction of the tubular case;

a microphone assembly to be mounted on the ring; and a gate ring which is to be mounted on an upper portion of the microphone assembly, and has a plurality of leg portions extending in an axial direction of the tubular case, wherein the substrate is mounted on the gate ring, and the side-surface sound hole is formed in the side surface of the tubular case and at a position where the side-surface sound hole communicates with a gap caused in the tubular case by the leg portions of the ring and the leg portions of the gate ring.

* * * * *